US006575304B2

(12) United States Patent
Cudahy

(10) Patent No.: US 6,575,304 B2
(45) Date of Patent: Jun. 10, 2003

(54) VIBRATING SCREEN APPARATUS

(76) Inventor: George F. Cudahy, 4 Cielo Lindo Dr., Anthony, NM (US) 88021

( * ) Notice: Subject to any disclaimer, the term of this patent is extended or adjusted under 35 U.S.C. 154(b) by 56 days.

(21) Appl. No.: 09/847,731

(22) Filed: May 2, 2001

(65) Prior Publication Data

US 2001/0025809 A1 Oct. 4, 2001

Related U.S. Application Data

(63) Continuation-in-part of application No. 09/320,033, filed on May 26, 1999, now abandoned.

(51) Int. Cl.[7] ..... B07B 1/42

(52) U.S. Cl. ..... 209/365.3; 209/315; 209/326; 209/365.1

(58) Field of Search ..... 209/326, 364, 209/365.1, 365.3, 366, 420, 421, 311, 315

(56) References Cited

U.S. PATENT DOCUMENTS 2,964,186 A * 12/1960 Ferrara ..... 209/326 X
3,003,635 A * 10/1961 Wood ..... 209/365.3 X
3,089,582 A * 5/1963 Musschoot et al. .. 209/365.3 X
5,199,574 A * 4/1993 Hollyfield, Jr. et al. ..... 209/365.1 X
5,397,002 A * 3/1995 Lambert ..... 209/347

FOREIGN PATENT DOCUMENTS

SU 1319926 * 6/1987 ..... 209/365.3

* cited by examiner

*Primary Examiner*—Tuan N. Nguyen
(74) *Attorney, Agent, or Firm*—Michelle Evans; Gunn, Lee & Hanov P.C.

(57) ABSTRACT

A vibrating screen apparatus for sizing materials is shown that has a minimum of moving parts therein. A vibrating motor is mounted below longitudinal vibrating bars. The vibrating bars are set on air mounts, which air mounts are between the vibrating bars and cross braces connected to the frame. The vibrating bars press against the underside of a vibrating screen to form a crown therein when the air mounts are inflated. The vibrating screen is stretched between the sides of the frame by tensioning rails. A shroud over the top of the frame is secured in place. Multiple size materials can be produced by stacking multiple vibrating screen apparatuses.

15 Claims, 5 Drawing Sheets

VIBRATING SCREEN APPARATUS

This application is a continuation-in-part of application Ser. No. 09/320,033, filed on May 26, 1999, now abandoned.

BACKGROUND OF THE INVENTION

1. Field of the Invention

This invention relates to a vibrating screen mechanism and, more particularly, to a vibrating screen mechanism that is used to separate materials by size.

2. Background of the Invention

For many years, vibrating screens have been used to separate products into different sizes. While some screens may be used in an environment that is relatively mild, other screens would be used in the harshest of environments, such as mines, quarries or plants, where materials, such a bauxite, gravel, crushed rock, limestone, cement, shale or clay, are sized into different sizes. In these harsh environments in which a vibrating screen operates, any mechanically moving parts can be fouled by dust, grit or grime from the materials being sized. The larger number of moving parts to operate the vibrating screen, the greater the probability there will be a mechanical failure. The simpler the operation of the vibrating screen, the less likely the mechanical parts will foul or break.

U.S. Pat. No. 4,444,656 to Nelson shows a vibrating screen with a plurality of transverse beams extending from side to side for vibrating the screen. A large number of beams are used, as well as a large number of moving parts. Likewise, a plurality of different motors are used, with each transverse beam having a different motor and a different rate of vibration.

Typical of the modern day vibrating screen are those screens disclosed in U.S. Pat. Nos. 3,378,142; 3,834,534; 4,180,458; 4,274,953; 4,340,469; 4,632,751; 5,100,539; 5,341,939; and 5,749,471. Unlike the present invention, in each of the referenced patents, a motor is attached to a frame to which is attached a screen. Activation of the motor causes the frame and consequently, the screen to vibrate. To allow such vibration, the frame is somehow affixed to isolating devices, usually springs. U.S. Pat. No. 3,378,142 imparts the vibrating force to the frame using "two drivingly coupled resiliently borne oscillating frames having alternative inter-engaging cross members." U.S. Pat. No. 3,834,534 attaches a screen to a frame using springs and then allows the vibration mode of the screen and frame assembly to be controlled as well as slid beneath the screen. U.S. Pat. No. 4,180,458 uses a traditional structure, but isolates the structure to achieve better noise control. U.S. Pat. No. 4,274,953 mounts the vibration motor on the outside of the frame. U.S. Pat. No. 4,340,469 imparts the vibrational force to the frame and screen using unbalanced weights to generate gyrational vibratory motion. U.S. Pat. Nos. 4,632,751; 5,100,539; 5,341,939; and 5,749,471 each contain disclosures typical of vibrating frame/screens. Unlike the present invention, all of the inventions disclosed in the foregoing patents contain complex vibrating mechanisms with multiple mechanical parts and the vibrating force is imparted to a frame which in turn causes the screen to vibrate.

Not known to be the subject of a U.S. patent, is the vibrating screen apparatus utilized by J&H Equipment, Inc. ("J&H"), P.O. Box 928, Roswell, Ga. 30077, telephone number (800) 989-1606. Unlike the present invention which does not attach the vibrating screen apparatus to the screen and which does not require attachment through the screen, the J&H vibrating screen apparatus attaches rods across and through a screen. The rods are then attached to an overhead motor which, when activated, unlike the present invention, causes the entire apparatus, screen rods and screen to vibrate.

To simply and advance the prior art, a vibrating screen apparatus must, as does the present invention, reduce the number and complexity of the mechanical parts necessary to cause vibration of the screen and which in fact vibrate. Furthermore, for ease of maintenance, the entire vibrating apparatus should easily remove from the screen system.

SUMMARY OF THE INVENTION

It is an object of the present invention to provide a vibrating screen apparatus with a minimum amount of moving parts.

It is a further object of the present invention to provide a vibrating screen apparatus that is easily maintained and repaired.

It is yet another object of the present invention to provide a vibrating screen apparatus that is more reliable and economical to operate.

It is an even further object of the present invention to provide a vibrating screen apparatus that has less dust pollution or noise proliferation.

It is yet another object of the present invention to have vibrating bars that run lengthwise of the screen to impart the necessary vibrations to the screen.

It is yet another object of the present invention to suspend the vibrating bars and pull the screen taut by inflating air mounts below the vibrating bars.

It is yet another object of the present invention to provide tension rails for proper tensioning of the wire cloth that makes up the vibrating screen.

It is even another object of the present invention to mount the vibrating motor to the vibrating bars to cause the vibration of the wire cloth of the vibrating screen apparatus.

In the present invention, side plates are held into position by cross braces to form the frame of the present vibrating screen apparatus. The bottom of the frame is enclosed by a concave surface and a discharge outlet for the fine material that has gone through the last screen.

The screen is made of wire cloth that is tightened by tension rails on each side. The tension rails connect into hooks that are attached to the wire cloth and pulled tight between the respective sides of the frame.

Immediately below the screen are vibrating bars that run lengthwise of the screen. Attached to the underside of the vibrating bars is a vibrating motor that will cause the bars to vibrate. On top of the vibrating bars is some type of resilient material, such as rubber, to keep the vibrating bars from wearing out the screen.

The vibrating bars are mounted on air mounts set on cross braces between the sides of the frame. By inflating the air mounts, the screen is tightened to the predetermined tautness that is desired when the vibrating bar is lifted. Tension on the wire cloth increased and the vibrating mechanism is ready to be turned ON for operation.

Material to be sized comes in at the feed end of the vibrating screen apparatus. Material that is less than the predetermined size of the wire cloth will go through the screen and be less than the predetermined size. The remainder of the material that is larger than the predetermined size will come out of the discharge end of the vibrating screen apparatus.

If material is to be sized between a predetermined range, vibrating screen apparatuses can be stacked one on top of the other and material that comes out of the discharge end of other than the top vibrating screen apparatus would be of a predetermined size range depending upon the size of the individual screens therebetween.

To prevent air pollution by dust and other particles, a cover will cover the uppermost of the vibrating screen apparatuses. In the present invention, a rubber dust cover is used that is ratcheted down tightly into place to prevent noise proliferation or environmental pollution by dust.

Since the entire vibrating screen apparatus is gravity fed, the angle of the frame should be at least greater than the angle of repose of the material being sized. It is anticipated the angle of repose would typically be between 15°–45°.

DESCRIPTION OF THE PREFERRED EMBODIMENT

Figure 1:
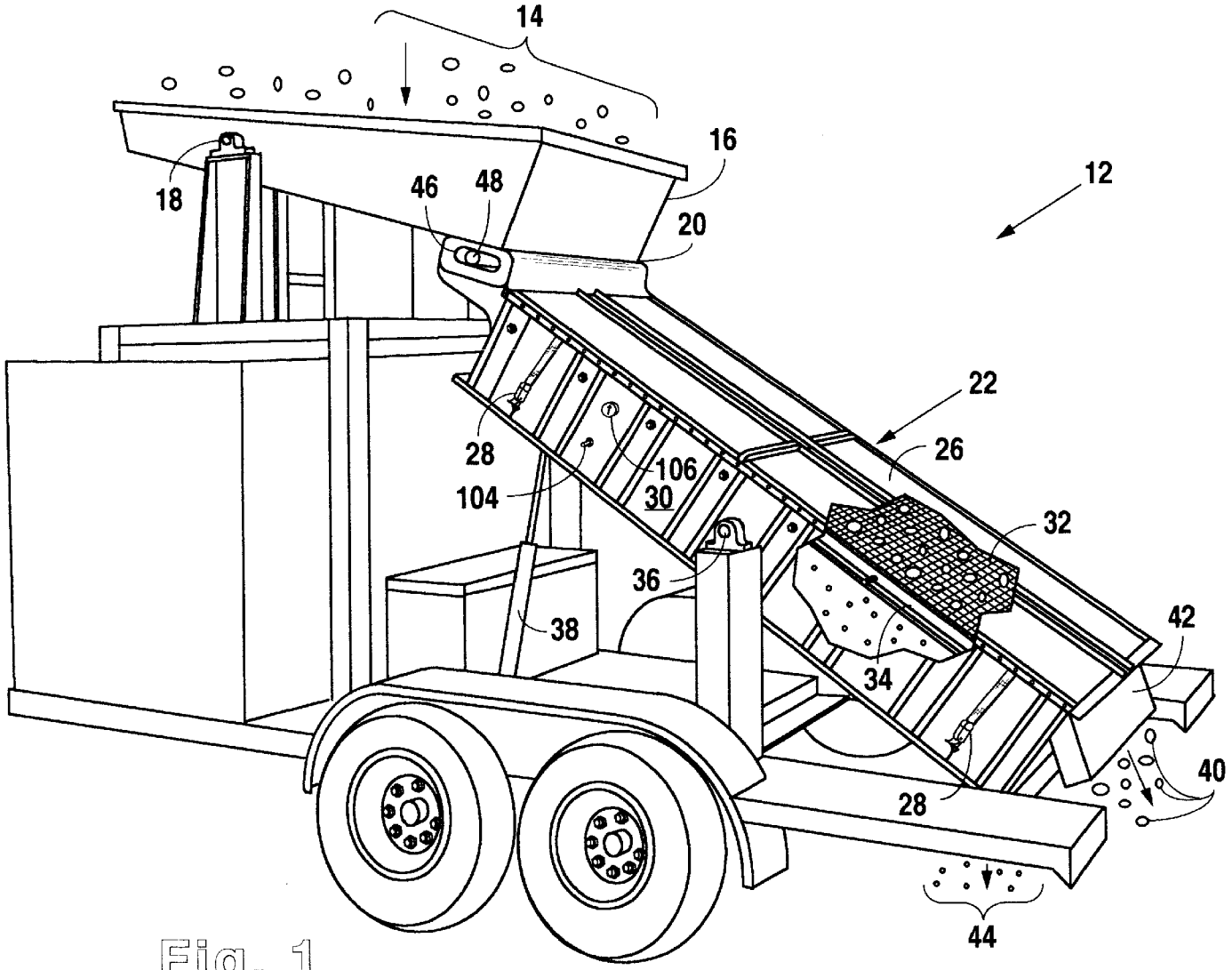
FIG. 1 is a perspective view of a demonstration model of the present invention with a portion cut away for illustration purposes.

Referring to FIG. 1 of the present invention, a description of a demonstrator model of the vibrating screen apparatus 12 is shown. Material to be sized 14 feeds into the hopper 16 of the present invention. The hopper 16 may be pivoted on pivot point 18 so that the material to be sized 14 feeds out of the hopper 16 at the lower end 20 thereof into the vibrating screen body 22. The vibrating screen body 22 has a frame 24 (shown in detail in FIG. 3) that is covered by a shroud 26. The shroud 26 is held in position by ratcheted tie-downs 28 on the side walls 30.

Inside of the vibrating screen body 22 is located a vibrating screen 32 that is typically made from a wire cloth. The vibrating screen 32 is tensioned between the respective side walls 30 by means of a tension rail 34.

The angle of repose of the vibrating screen body 22 is great enough so the material be sized 14 will flow there along by gravity. The vibrating screen body 22 may be pivoted on pivot point 36 by means of hydraulic ram 38. By extending the hydraulic ram 38, the angle of repose can be increased. The slot 46 along with the pivot bar 48 allow for adjustment of the angle of repose between the hopper 16 and the vibrating screen body 22. As the material to be sized 14 feeds through the vibrating screen body 22, the larger particles 40 that will not go through the vibrating screen 32 and come out the discharge end 42. The sized particles 44 that are smaller than the spaces in the vibrating screen 32 come out of the bottom of the vibrating screen body 22.

Figure 2:
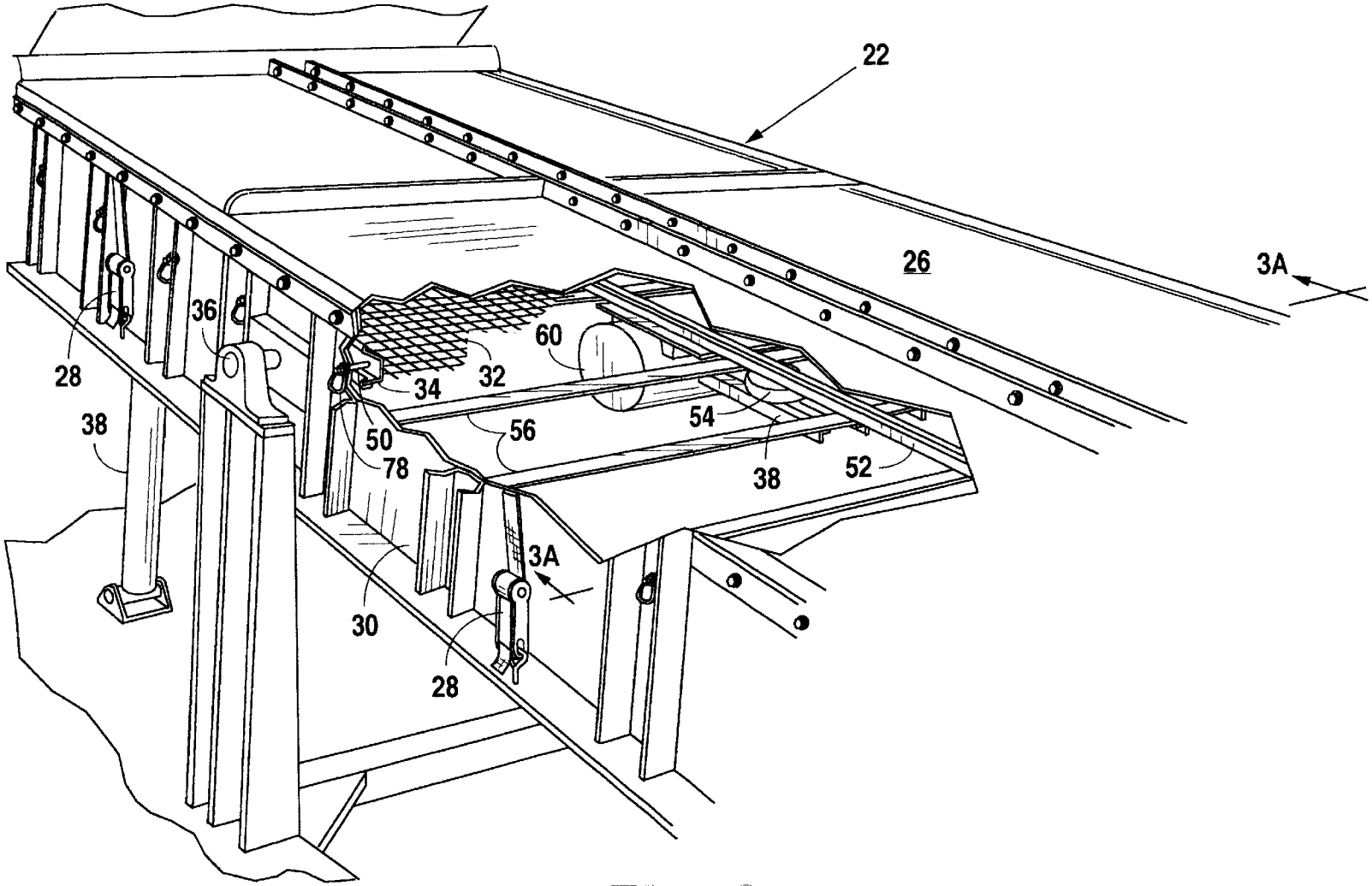
FIG. 2 is a partial perspective cutaway view of the present invention illustrating the mounting of the vibrating bar.
Figure 6:
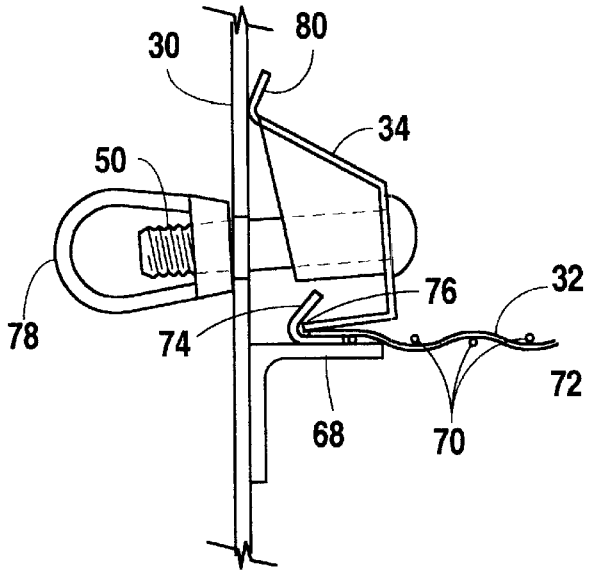
FIG. 6 is an enlarged partial sectional view illustrating the tensioning of the wire cloth.

Referring now to FIG. 2 of the drawings, an enlarged partial sectional view of the vibrating screen body 22 is shown. A portion of the shroud 26 has been cut away to illustrate the screen 32 being stretched between the sides 30 by means of tension rail 34 being tightened into position by bolts 50. This will be explained in more detail in conjunction with FIG. 6.

Immediately below the vibrating screen 32, which is made of wire cloth, is located two parallel vibrating rails 52. The vibrating rails 52 run lengthwise along the vibrating screen body 22 from one end thereof to the other. The vibrating rails 52 are supported on the bottom thereof by air mounts 54. The air mounts 54 are mounted to cross braces 56 by means of a mounting platform 58.

Suspended below vibrating rails 52 is a vibrating motor 60. Vibrating motor 60 attaches directly to vibrating rails 52 by any convenient means, such as base 62. By turning on the vibrating motor 60, through the base 62, it causes the vibrating rails 52 to vibrate. The vibration of the vibrating rails 52 will in turn cause the screen 32 to vibrate. By inflating the air mounts 54, the vibrating rails 52 will be the sole contact between the screen 32, other than the edges that are tightened into place by tension rail 34.

Figure 3:
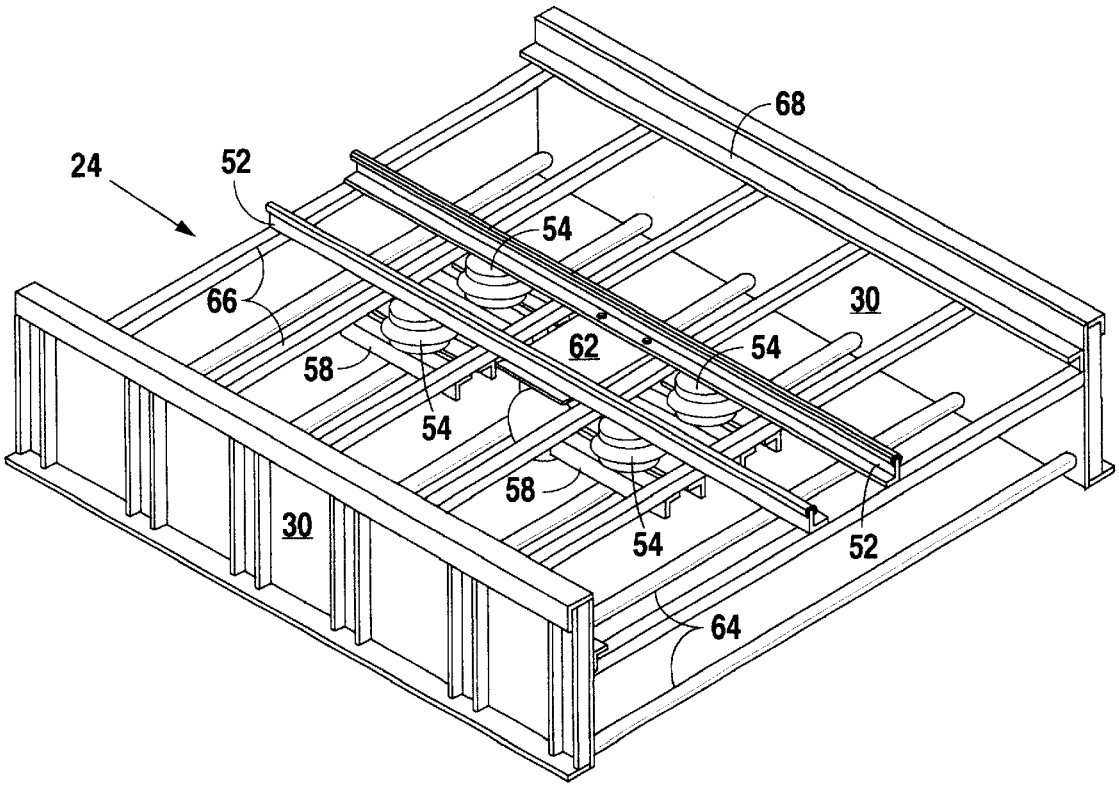
FIG. 3 is a perspective view of the frame with the vibrating bar as mounted therein.

Turning now to FIG. 3 of the drawings, the frame 24 will be explained in more detail. The side walls 30 make up the sides of the frame 24. Across the bottom of the frame 24 are lower cross braces 64, which can be of any dimension; however, applicant has found that circular braces do not cause an accumulation of the material being sized.

Towards the upper part of the side walls 30 are the upper cross braces 66. While the upper cross braces 66 can be of any particular size, square bar stock has found to be particularly suitable for this particular application. The upper cross braces 66 connect to the side walls 30 just below the vibrating screen mount 68. The vibrating rails 52 are secured to the top of the air mounts 54. The air mounts 54 are secured to the frame 24 by means of mounting platform 58 on upper cross braces 66. The vibrating motor 60 suspends below the vibrating rails 52 by means of inverted base 62.

Figure 3A:
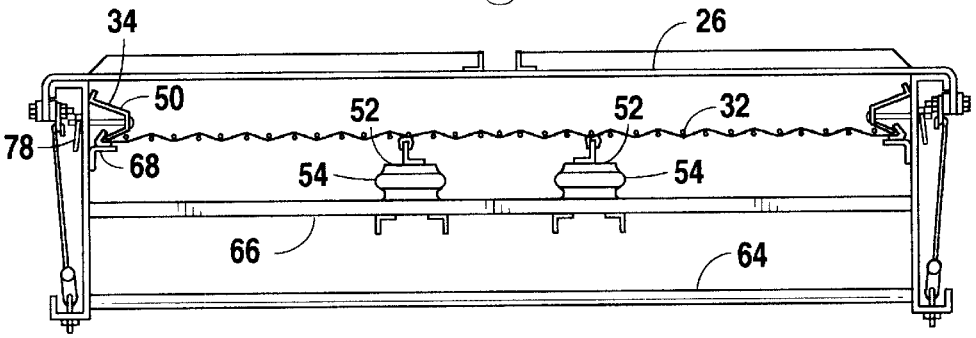
FIG. 3A is a cross-sectional view of the vibrating mechanism of FIG. 2 along section lines 3A—3A, with the air mounts deflated.
Figure 3B:
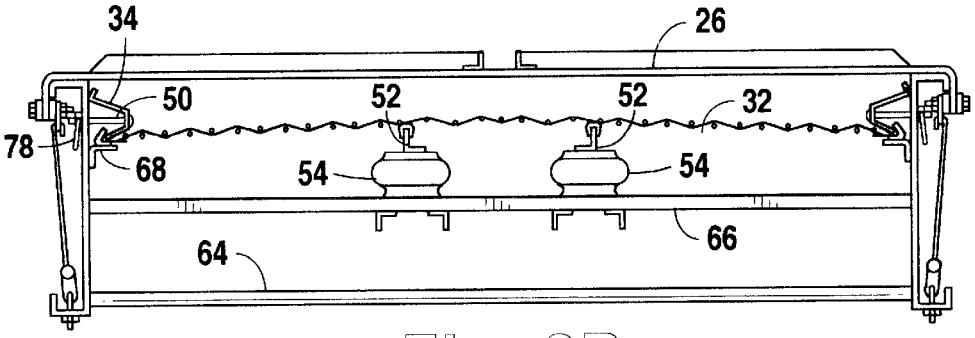
FIG. 3B is a cross-sectional view of the vibrating mechanism of FIG. 2 along section lines 3A—3A, with the air mounts inflated.

Referring now to FIGS. 3A and 3B in combination, the proper tensioning of the vibrating screen 32 is shown and explained. Referring first to the tightening of the vibrating screen 32, enlarged FIG. 6 may be useful. The vibrating screen 32 is a wire cloth that is made with a predetermined mesh. The wire cloth has warp wires 70 that run lengthwise along the vibrating screen and shoot wires 72 that run perpendicular to the warp wire and perpendicular to the side walls 30. For the purpose of tensioning vibrating screen 32, some type of hook or connection is provided on the chute wires 72. In the present case, hooks 74 are contained on the ends of the chute wires 72.

To install the vibrating screen 32, it is placed inside of the vibrating screen body 22 on the vibrating screen mount 68. Then the hook side 76 of the tension rail 34 is placed inside of the hooks 74. By tightening nuts 78 on bolts 50, the slide side 80 of the tension rail 34 will slide along the side 30 and allow the tension rail 34 to tighten screen 32 by pulling against the hooks 74. By tightening the nuts 78 on the bolts 50, the vibrating screen 32 can be tightened to any desired tension. However, care should be exercised not to tighten too much, otherwise any bend contained in the warp wires or chute wires of the vibrating screen 32 may be deformed.

Figure 8:
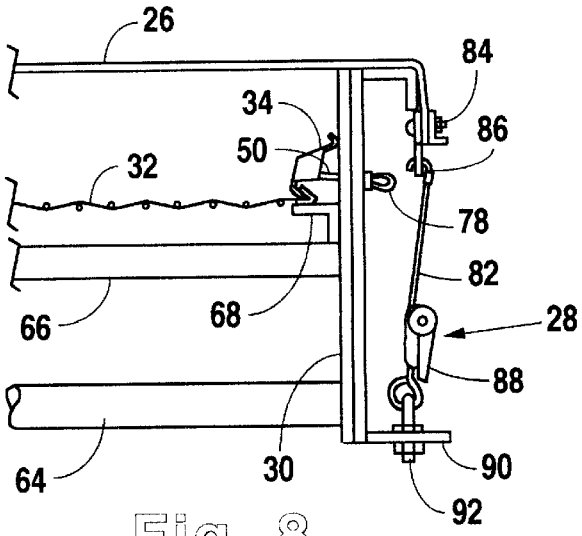
FIG. 8 is a partial sectional view illustrating the tensioning of the wire cloth and the securing of the shroud.

Again, referring to FIGS. 3A and 3B, the tightening of the shroud 26 will be explained in conjunction with enlarged cross-sectional view FIG. 8. The ratcheted tie-downs 28 will be explained in more detail. A strap 82 is connected to the shroud 26 by any convenient means, such as bolts 84 having eyelets with hooks 86 running therethrough. The hooks 86 connect to strap 82, which are tightened by ratchet 88. The other side of the ratchet 88 is connected to side wall 30 by means of flange 90 and bolt 92.

In FIG. 3A, the air mounts 54 are deflated and the vibrating screen 32 is in its lowermost position. However, in FIG. 3B, the air mounts 54 are inflated so the vibrating rails 52 are raised up. In that manner, the vibrating screen 32 forms a crown and only comes into contact with the vibrating rails 52. Therefore, when the vibrating rails 52 vibrate, the screen 32 will vibrate.

Figure 7:
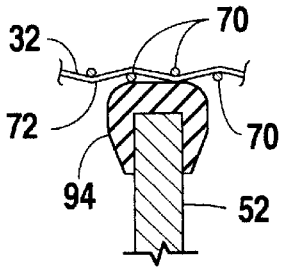
FIG. 7 is an enlarged partial sectional view illustrating contact between the vibrating bar and the wire cloth.

Referring to FIG. 7, the top part of the vibrating rail 52 is shown. The uppermost portion of vibrating rail 52 is capped by a rubber grommet 94 to prevent damage to the vibrating screen 32. Any other type of resilient material to prevent damage to vibrating screen 32 can be used. In situations where a hot material is being sized, the rubber grommet 94 can be replaced with a heat resistant flexible material or even eliminated, if necessary.

Figure 5:
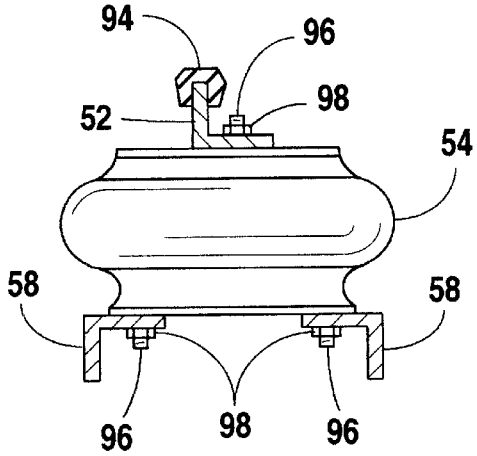
FIG. 5 is an enlarged partial sectional view illustrating positioning of the air mounts between the vibrating bar and the cross braces.

Referring now to FIG. 5, the mounting of the vibrating rail 52 to the air mount 54 is illustrated. The vibrating rail 52 may be connected to air mount 54 by any convenient means, such as bolt 96 and nut 98. On the underside, the air mount 54 is connected to the mounting platform 58 by means of similar bolt 96 and nut 98. Also, the rubber grommet 94 is illustrated on the vibrating rail 52.

Figure 4:
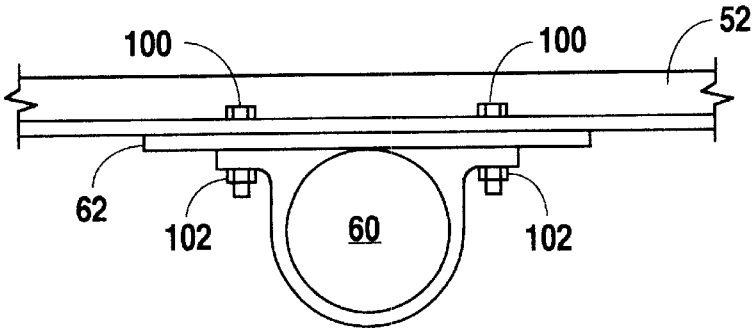
FIG. 4 is a side view illustrating the mounting of the motor to the vibrating bar.

FIG. 4 shows the mounting of the vibrating motor 60 on the underside of the vibrating rails 52 by means of bolts 100 and nuts 102 through base 62. The vibrating motor may be of any particular type, but applicant has found that motors made by Visam are particularly suited for the present operation because of the adjustability of their speed and vibrating weight. Also, these motors have variable frequencies and may differ in power requirements according to the needs of the particular situation. The particular Visam motor can be selected and set according to the particular requirements of the job.

In actual operation, the vibrating screen apparatus can be tightened to a particular tension by inflating the air mounts 54 through inflating valve 104 as shown in FIG. 1. The inflating valve is connected by hoses (not shown) to the air mounts 54. The pressure gauge 106 measures the amount of pressure that has been inserted in the air mount 54. By use of the air mounts 54 and inflating them to a predetermined pressure, the tension on the vibrating screen 32 is continually adjusted. This adjustment eliminates the re-tensioning of the screen 32 or makes the re-tensioning a less frequent requirement.

By putting the material to be sized 14 into hopper 16 and allowing it to flow through the lower end 20 thereof into the vibrating screen body 22, material to be sized 14 now flows along the vibrating screen body 22. Particles that were too large to flow through the vibrating screen 32 will come out the discharge end 42 as larger particles 40. The sized particles 44 will flow out of the bottom of the vibrating screen body 22.

Figure 9:
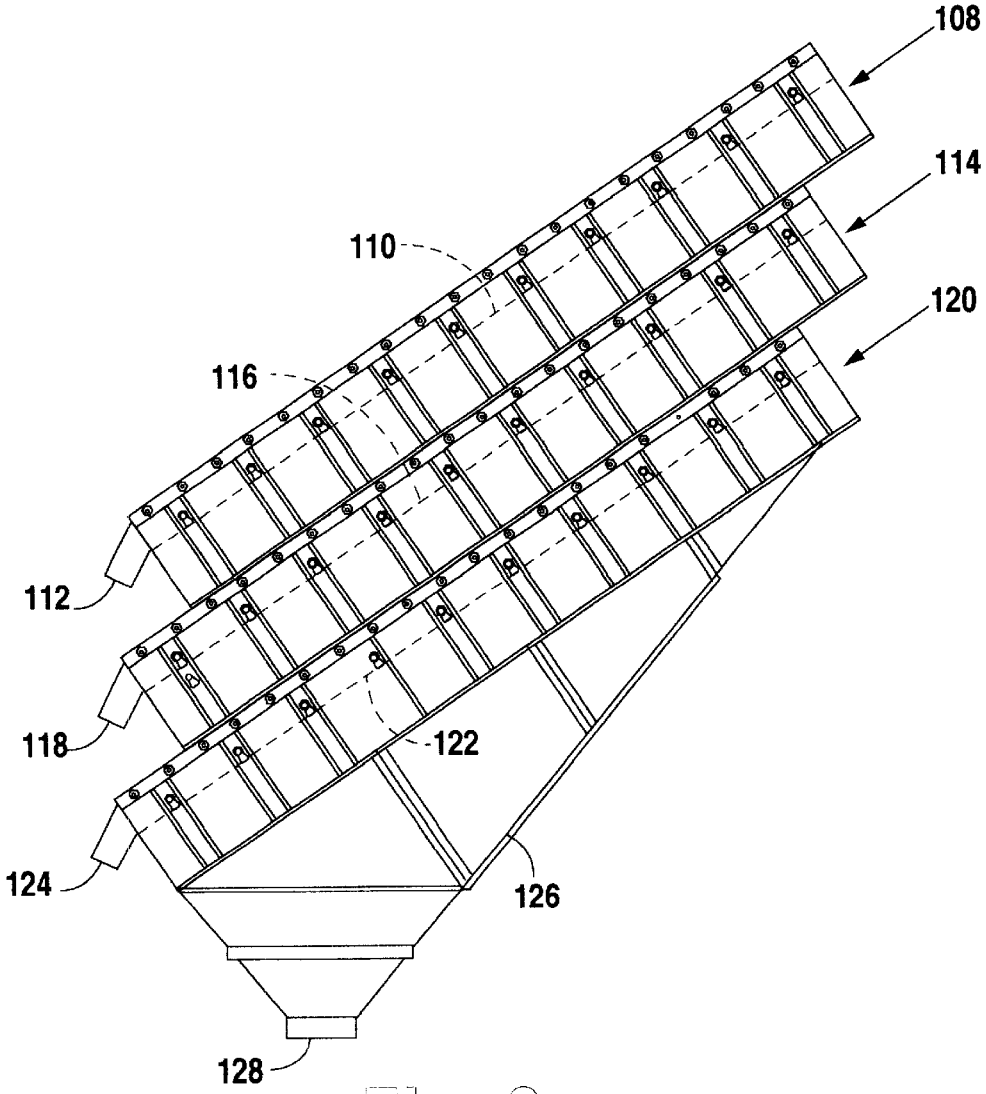
FIG. 9 is a side view illustrating the stacking of multiple vibrating screens to give multiple size materials therefrom.

To size particles over a range, the vibrating screen bodies 22 may be stacked in a manner as shown in FIG. 9. The material to be sized 14 would then flow into the upper vibrating screen body 108. The particles that were too large to flow through the upper vibrating screen 110 will then come out of discharge end 112. However, the materials that flow through the upper vibrating screen 110 into the intermediate vibrating screen body 114 will then be vibrated along intermediate vibrating screen 116. Hence, particles that would flow through upper vibrating screen 110, but not intermediate vibrating screen 116, would come out intermediate discharge 118. Therefore, the particles coming out of intermediate discharge 118 are of a predetermined size range. For further refinement, a lower vibrating screen body 120 with a lower vibrating screen 122 is also included. From the lower discharge 124, even finer size particles are discharged that would flow through upper vibrating screen 100, intermediate vibrating screen 116, but not lower vibrating screen 122.

In the stacking of vibrating screen bodies as illustrated in FIG. 9, the coarser vibrating screens are at the top and the finer vibrating screens are at the bottom. From the lower vibrating screen body 120 is located a bottom chute 126, with a bottom funnel 128. Only the finest of particles would come out of bottom funnel 128, which particles would flow through each of the upper vibrating screen 110, intermediate vibrating screen 116, and lower vibrating screen 122. In this manner, a different range of sized particles can be determined in any given condition.

I claim:

1. A vibrating screen apparatus operated from a power source for separating material by size, said vibrating screen apparatus comprising:

a frame having side walls and cross braces, vibrating screen between said side walls;

a tensioning device for stretching said vibrating screen between said side walls;

vibrating bars beneath and adjacent said vibrating screen, said vibrating bars being generally parallel to side walls;

vibrator attached to said vibrating bars to cause vibration thereof upon activation from said power source; and air mount isolators mounted between said cross braces and said vibrating bar to help isolate vibrations from said frame, said air mount isolators allowing said vibrating bar to vibrate and to help prevent noise from said vibration, wherein upon inflation of said air mounts isolators, a lengthwise crown is formed in said vibrating screen and tension therein is increased and wherein said air mounts isolators are located on both sides of said vibrator, said vibrator being located near the middle of said vibrating bars.

2. The vibrating screen apparatus of claim 1 wherein said tensioning device is rails bolted to said side walls with one edge of said rails catching an edge of said vibrating screen for stretching therebetween.

3. The vibrating screen apparatus of claim 2 wherein said vibrating screen is a wire cloth with hooks on each said edge thereof for said catching of said one edge of said rails.

4. The vibrating screen apparatus of claim 1 further comprising a shroud over a top of said frame, said shroud being secured to said side walls and preventing pollution.

5. The vibrating screen apparatus of claim 4 further having a bottom of said frame forming into a gravity fed chute for collecting said materials after sizing by falling through said vibrating screen.

6. The vibrating screen apparatus of claim 5 further comprising a hopper for receiving said materials and feeding said materials to an upper end of said vibrating screen, discharge end at a lower end of said vibrating screen for discharging material that did not flow through said vibrating screen.

7. The vibrating screen apparatus of claim 6 further comprising multiple layers of said vibrating screen apparatus with each layer having a separate discharge end for collecting said materials that would not flow through said vibrating screen for that layer, coarser vibrating screens being on top and progressively finer vibrating screens being therebelow.

8. A method of operation of said vibrating screen apparatus of claim 1 for separation of materials into different sizes, said method including the following steps:

setting said vibrating screen apparatus at an incline;

tensioning said vibrating screen between said side walls of said vibrating screen apparatus;

inflating said air mount isolators below said vibrating bars to form a longitudinal crown in said vibrating screen, said air mount isolators help isolate vibrations from said side walls to reduce noise; causing said longitudinal vibrating bars to vibrate and hence said vibrating screen to vibrate;

feeding said materials onto an upper end of said vibrating screen;

collecting said material that flows through said vibrating screen, which materials are less than a predetermined size; and discharging said materials out of a discharge end if said materials did not flow through said vibrating screen, which said materials are larger than a predetermined size.

9. The method of operation of claim 8 wherein said varying step includes mounting said vibrator to said vibrating bars and turning ON said power source.

10. The method of operation of claim 9 if wherein said air mount isolators are located on both sides of said power source and adjacent to said vibrating screen.

11. The method of operation of claim 10 wherein tension on said vibrating screen is increased during said inflating step.

12. The method of operation of claim 8 wherein said tensioning step includes tightening said tensioning device being tension rails on said side wall, said tension rails catching said vibrating screen for stretching between said side walls.

13. The method of operation of claim 8 having multiple layers of said vibrating screen apparatuses connected together with a coarser vibrating screen being on top and progressively finer vibrating screen being located therebelow to separate said material into multiple size ranges.

14. The method of operation of claim 8 including an additional step of tightening said shroud over said side walls of said vibrating screen apparatus to prevent pollution.

15. The method of operation of claim 8 wherein said setting step causes said incline to be greater than an angle of repose of said material.

* * * * *

Disclaimer

6,575,304 — George F. Cudahy, 4 Cielo Lindo Dr., Anthony, NM (US) 88021. VIBRATING SCREEN APPARATUS. Patent dated June. 10, 2003. Disclaimer filed Dec. 22, 2011, by the inventor George F. Cudahy.

Hereby disclaims claims 1-15 of the patent.

(*Official Gazette, January 31, 2012*)

Disclaimer

6,575,304 B2—George F. Cudahy, Anthony, NM (US). VIBRATING SCREEN APPARATUS. Patent dated June 10, 2003. Disclaimer filed December 22, 2011, by the inventor.

Hereby disclaims to the complete claims 1-15 of the said patent.

(*Official Gazette, February 21, 2012*)